US011004300B2

(12) United States Patent
Oyama et al.

(10) Patent No.: US 11,004,300 B2
(45) Date of Patent: May 11, 2021

(54) INFORMATION PROCESSOR, RECORDING MEDIUM, AND GAME CONTROL METHOD

(71) Applicant: Universal Entertainment Corporation, Tokyo (JP)

(72) Inventors: Masaki Oyama, Tokyo (JP); Atsushi Kumita, Tokyo (JP); Toshikazu Jinnouchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 77 days.

(21) Appl. No.: 16/136,898

(22) Filed: Sep. 20, 2018

(65) Prior Publication Data

US 2019/0096162 A1 Mar. 28, 2019

(30) Foreign Application Priority Data

Sep. 27, 2017 (JP) ..... JP2017-186443

(51) Int. Cl.
*G07F 17/32* (2006.01)
*G06Q 50/34* (2012.01)
*G07F 17/34* (2006.01)

(52) U.S. Cl.
CPC ..... *G07F 17/3211* (2013.01); *G06Q 50/34* (2013.01); *G07F 17/323* (2013.01); *G07F 17/3223* (2013.01); *G07F 17/34* (2013.01)

(58) Field of Classification Search
CPC ..... G07F 17/3211; G07F 17/3223; G07F 17/323; G07F 17/34; G06Q 50/34
See application file for complete search history.

(56) References Cited

U.S. PATENT DOCUMENTS

2009/0191962 A1* 7/2009 Hardy ..... G07F 17/3255 463/29
2011/0218891 A1* 9/2011 Sjelvgren ..... G06Q 40/12 705/30
2011/0244935 A1* 10/2011 Matthews ..... G07F 17/3295 463/9
2018/0085666 A1* 3/2018 Slabbert ..... G07F 17/3227

* cited by examiner

*Primary Examiner* — Werner G Garner
(74) *Attorney, Agent, or Firm* — Simpson & Simpson, PLLC; S. Peter Konzel

(57) ABSTRACT

An information processor includes: a display configured to display a screen of a game; a storage device configured to store an amount of a gaming medium usable in the game; and a controller programmed to execute the process of: comparing an amount of the gaming medium stored in the storage device with an amount of the gaming medium at login to the game, and displaying a predetermined message on the display when a relation between these amounts becomes equal to a predetermined ratio.

10 Claims, 12 Drawing Sheets

FIG.6

SYMBOL ARRAYS ON VIDEO REELS

| | REEL 1 | REEL 2 | REEL 3 | REEL 4 | REEL 5 |
|---|---|---|---|---|---|
| 0 | HEART | 9 | CHERRY | 9 | KING |
| 1 | CHERRY | JACK | KING | JACK | ACE |
| 2 | 7 | HEART | 9 | WILD | BELL |
| 3 | JACK | 7 | ACE | 9 | KING |
| 4 | KING | 10 | BELL | JACK | WATERMELON |
| 5 | WATERMELON | 9 | 10 | HEART | WATERMELON |
| 6 | 10 | ACE | WATERMELON | KING | QUEEN |
| 7 | BELL | BELL | 10 | JACK | HEART |
| 8 | JACK | JACK | CHERRY | 10 | JACK |
| 9 | 9 | WATERMELON | 10 | BELL | 9 |
| 10 | ACE | 9 | WATERMELON | 9 | CHERRY |
| 11 | JACK | CHERRY | JACK | ACE | 10 |
| 12 | ACE | ACE | KING | ACE | 7 |
| 13 | BELL | QUEEN | HEART | 9 | ACE |
| 14 | KING | 9 | 7 | QUEEN | JACK |
| 15 | QUEEN | KING | 10 | 7 | 9 |
| 16 | HEART | WILD | 7 | CHERRY | KING |
| 17 | JACK | ACE | QUEEN | HEART | JACK |
| 18 | 10 | QUEEN | 10 | ACE | ACE |
| 19 | 9 | WATERMELON | WILD | KING | BELL |
| 20 | 9 | 10 | QUEEN | WATERMELON | QUEEN |
| 21 | CHERRY | 9 | 10 | 10 | ACE |
| 22 | JACK | QUEEN | CHERRY | BELL | 9 |
| 23 | 10 | CHERRY | ACE | 9 | WATERMELON |
| 24 | WATERMELON | ACE | QUEEN | 10 | 10 |
| 25 | JACK | 9 | QUEEN | CHERRY | ACE |
| 26 | | 7 | BELL | KING | CHERRY |
| 27 | | 10 | 9 | | QUEEN |
| 28 | | BELL | | | ACE |
| 29 | | | | | HEART |
| 30 | | | | | 10 |
| 31 | | | | | BELL |
| 32 | | | | | ACE |
| 33 | | | | | KING |
| 34 | | | | | |

FIG.7

SYMBOL COMBINATION TABLE

| SYMBOL | GRAPHICS | 1 | 2 | 3 | 4 | 5 |
|---|---|---|---|---|---|---|
| WILD | | 0 | 0 | 0 | 0 | 0 |
| 7 | | 0 | 0 | 50 | 300 | 1000 |
| HEART | | 0 | 0 | 35 | 200 | 800 |
| BELL | | 0 | 0 | 30 | 100 | 500 |
| WATERMELON | | 0 | 0 | 20 | 50 | 300 |
| CHERRY | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |

INFORMATION PROCESSOR, RECORDING MEDIUM, AND GAME CONTROL METHOD

CROSS-REFERENCE TO RELATED APPLICATION

This application is entitled to the benefit of Japanese Patent Application No. 2017-186443 filed on Sep. 27, 2017.

BACKGROUND OF THE INVENTION

1. Field of the Invention

The present invention relates to an information processor, a recording medium, and a game control method.

2. Description of Related Art

There have been various games played on stationary home game consoles, game machines installed in facilities, and information processors such as smartphones. For example, there is a slot game which is arranged such that it is played by betting gaming media such as coins and a benefit (payout) is awarded in accordance with betted gaming media and a combination of symbols displayed on a screen (i.e., a game result). Such a game is basically enjoyed by repeating a game cycle (unit game) from the start of the game by betting of gaming media to the acquisition of a game result (Patent Literature 1 (International Publication No. WO2016/136749A1)).

BRIEF SUMMARY OF THE INVENTION

The above-described slot game is disadvantageous in that, while the slot game is started and repeatedly played, the gaming media are consumed and the player may run out of his/her gaming media without being aware of it, with the result that the player cannot continue the game.

An object of the present invention is to provide an information processor, a recording medium, and a game control method, which are able to notify the need of acquisition of gaming media before gaming media are exhausted and a game becomes no longer playable.

The present invention relates to an information processor including: a display configured to display a screen of a game;

a storage device configured to store an amount of a gaming medium usable in the game; and a controller programmed to execute the process of:

comparing an amount of the gaming medium stored in the storage device with an amount of the gaming medium at login to the game, and displaying a predetermined message on the display when a relation between these amounts becomes equal to a predetermined ratio.

According to the arrangement above, when the ratio of the amount of the currently-owned gaming media to the amount of the gaming media owned at the login to the game becomes equal to the predetermined ratio as a result of consumption of the gaming media, the predetermined message is displayed on the display. This allows the player to know that the gaming media have been consumed and must be obtained (by exchanging, etc.) before the game becomes no longer playable. It is therefore possible to prompt the player to consume the gaming media.

The present invention relates to an information processor including: a display configured to display a screen of a game;

a storage device configured to store an amount of a gaming medium usable in the game; and a controller programmed to execute the process of:

(1a) when the login to the game has been done, storing an amount of the gaming medium at the login stored in the storage device;

(1b) enabling acquisition of the gaming medium by communication with a management system managing the gaming medium, and if the gaming medium is acquired, updating the amount of the gaming medium stored in the storage device;

(1c) dividing the amount of the gaming medium stored in the storage device by the amount of the gaming medium at the login, which is stored in the step (1a); and (1d) displaying a message notifying that a shift to the process (1b) is possible on the display, when the amount calculated in the process (1c) is smaller than a predetermined amount.

According to the arrangement above, when the amount of the currently-owned gaming media becomes smaller than the predetermined ratio (predetermined amount) as a result of consumption of the gaming media as compared to the amount of the gaming media owned at the login to the game, the message notifying that the gaming media can be acquired is displayed. With this arrangement, the player is informed in advance to be able to obtain the gaming media, before the gaming media are consumed and the game becomes no longer playable. It is therefore possible to prompt the player to consume the gaming media.

In addition to the above, the above-described information processor of the present invention is arranged such that when in the process (1d) the amount calculated in the process (1c) is smaller than the predetermined amount, an input unit by which the shift to the process (1b) is possible is presented.

According to the arrangement above, when the amount of the currently-owned gaming media becomes smaller than the predetermined ratio (predetermined amount) as a result of consumption of the gaming media as compared to the amount of the gaming media owned at the login to the game, a direct shift to an environment in which the gaming media can be acquired is possible through an input to the input means.

The present invention relates to a game control method including the steps of:

(2a) when login to a game has been done, storing an amount of a gaming medium usable in the game, which is stored in a storage device at the login;

(2b) enabling acquisition of the gaming medium by communication with a management system managing the gaming medium, and if the gaming medium is acquired, updating the amount of the gaming medium stored in the storage device;

(2c) dividing the amount of the gaming medium stored in the storage device by the amount of the gaming medium at the login, which is stored in the step (2a); and (2d) displaying a message notifying that a shift to the step (2b) is possible on a display, when the amount calculated in the step (2c) is smaller than a predetermined amount.

According to the method above, when the amount of the currently-owned gaming media becomes smaller than the predetermined ratio (predetermined amount) as a result of consumption of the gaming media as compared to the amount of the gaming media owned at the login to the game, the message notifying that the gaming media can be acquired is displayed. With this arrangement, the player is informed in advance to be able to obtain the gaming media, before the gaming media are consumed and the game becomes no longer playable. It is therefore possible to prompt the player to consume the gaming media.

The present invention relates to a non-temporary recording medium storing a game program executed by a computer of an information processor, the game program causing the computer to execute the processes of:

(3a) when login to a game has been done, storing an amount of a gaming medium usable in the game, which is stored in a storage device at the login;

(3b) enabling acquisition of the gaming medium by communication with a management system managing the gaming medium, and if the gaming medium is acquired, updating the amount of the gaming medium stored in the storage device;

(3c) dividing the amount of the gaming medium stored in the storage device by the amount of the gaming medium at the login, which is stored in the step (3a); and (3d) displaying a message notifying that a shift to the process (3b) is possible on a display, when the amount calculated in the process (3c) is smaller than a predetermined amount.

According to the arrangement above, when the amount of the currently-owned gaming media becomes smaller than the predetermined ratio (predetermined amount) as a result of consumption of the gaming media as compared to the amount of the gaming media owned at the login to the game, the message notifying that the gaming media can be acquired is displayed. With this arrangement, the player is informed in advance to be able to obtain the gaming media, before the gaming media are consumed and the game becomes no longer playable. It is therefore possible to prompt the player to consume the gaming media.

An information processor, a recording medium, and a game control method, which are able to notify the need of acquisition of gaming media before gaming media are exhausted and a game becomes no longer playable, are provided.

BRIEF DESCRIPTION OF THE DRAWINGS

FIG. 6 is an explanatory diagram illustrating symbol arrays of video reels in the slot game.

FIG. 7 is an explanatory diagram of a symbol combination table regarding the slot game.

DETAILED DESCRIPTION OF THE PREFERRED EMBODIMENT

Embodiment

An information processor of the present invention will be described with reference to figures.

A game executed in the present embodiment is, as application software (a program and game data), installed in and executed by an information processor. Examples of the information processor include mobile information devices such as a smartphone, a portable computer, a laptop computer, a note PC, a tablet PC, a handheld PC, and a PDA (Personal Data Assistant). The application software by which the game is executed is downloaded from a server or the like via communication means (see FIG. 2) and stored in a storage device in the information processor (flash memory 104). The communication means may be an interactive communication passage such as the Internet and a cable TV, or may be one-way broadcasting.

The application software by which the game is executed may be stored in a recording medium such as a CD-ROM, a DVD-ROM, an MO (optical magnetic disc), and a flash memory, and may be read from the recording medium and installed in the storage device of the information processor according to need.

Figure 1:
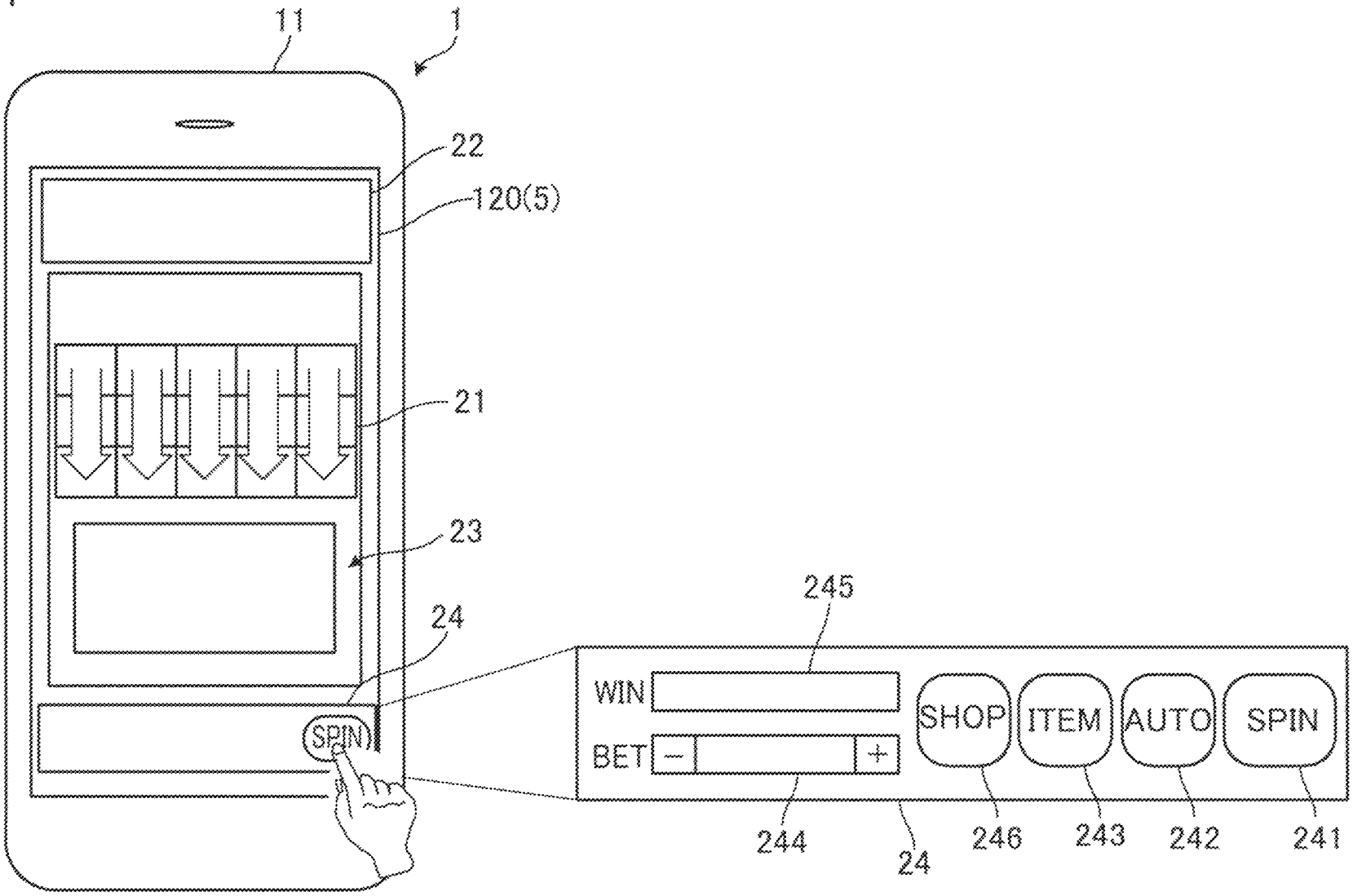
FIG. 1 illustrates image display on a smartphone (information processor).

In the present embodiment, a smartphone 1 shown in FIG. 1 is taken as an example of the information processor. While the descriptions below deal with the smartphone 1, processes and operations of the smartphone 1 can be interpreted as those of a program or a game control method.

(Online)

Figure 2:
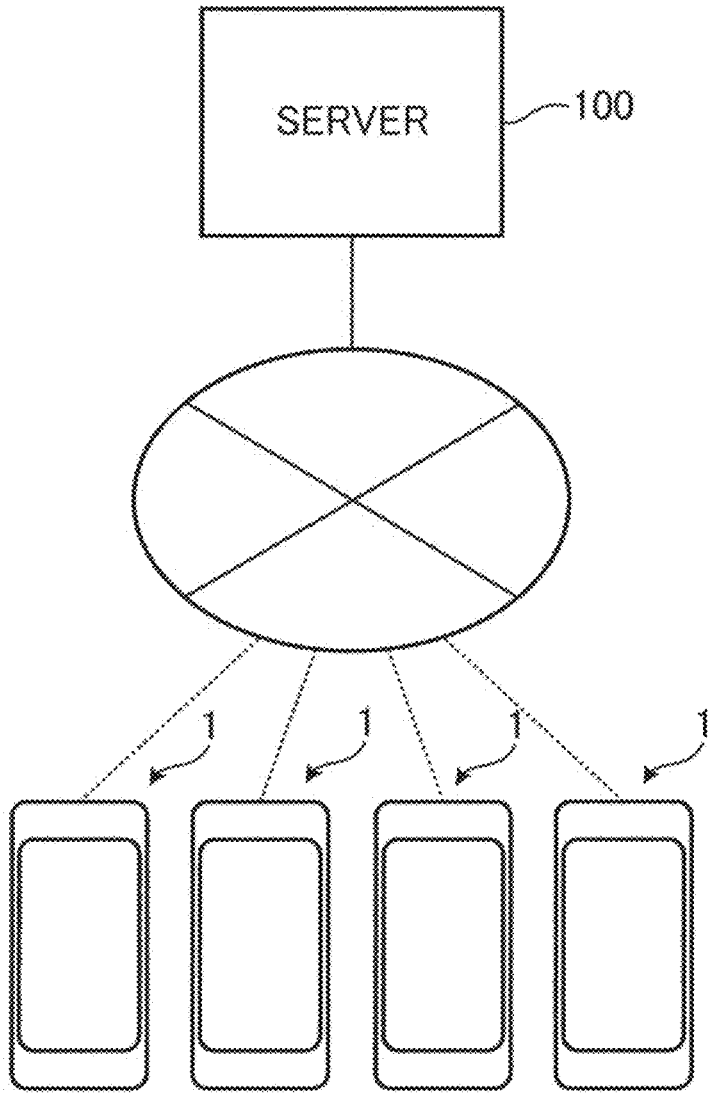
FIG. 2 illustrates a network environment between the smartphone and a server.

A game executed in the present embodiment is a slot game and is executed as an online game. To be more specific, as shown in FIG. 2, a server 100 managed by an administration organization of the slot game is connected to smartphones 1 of many players over a computer network (Internet).

In tis way, the slot game is executed online. The player is therefore able to download application software of the slot game from t server 100, install the software in the smartphone 1, and run the slot game. The server 100 (management system) is configured to exchange credits (which can be bought by cash, a credit card, electronic money, a prepaid card, etc.) owned by players to coins (gaming media) which are electronic information usable in the slot game, and to manage the coins owned by the players.

(Structure of Smartphone 1)

Figure 3:
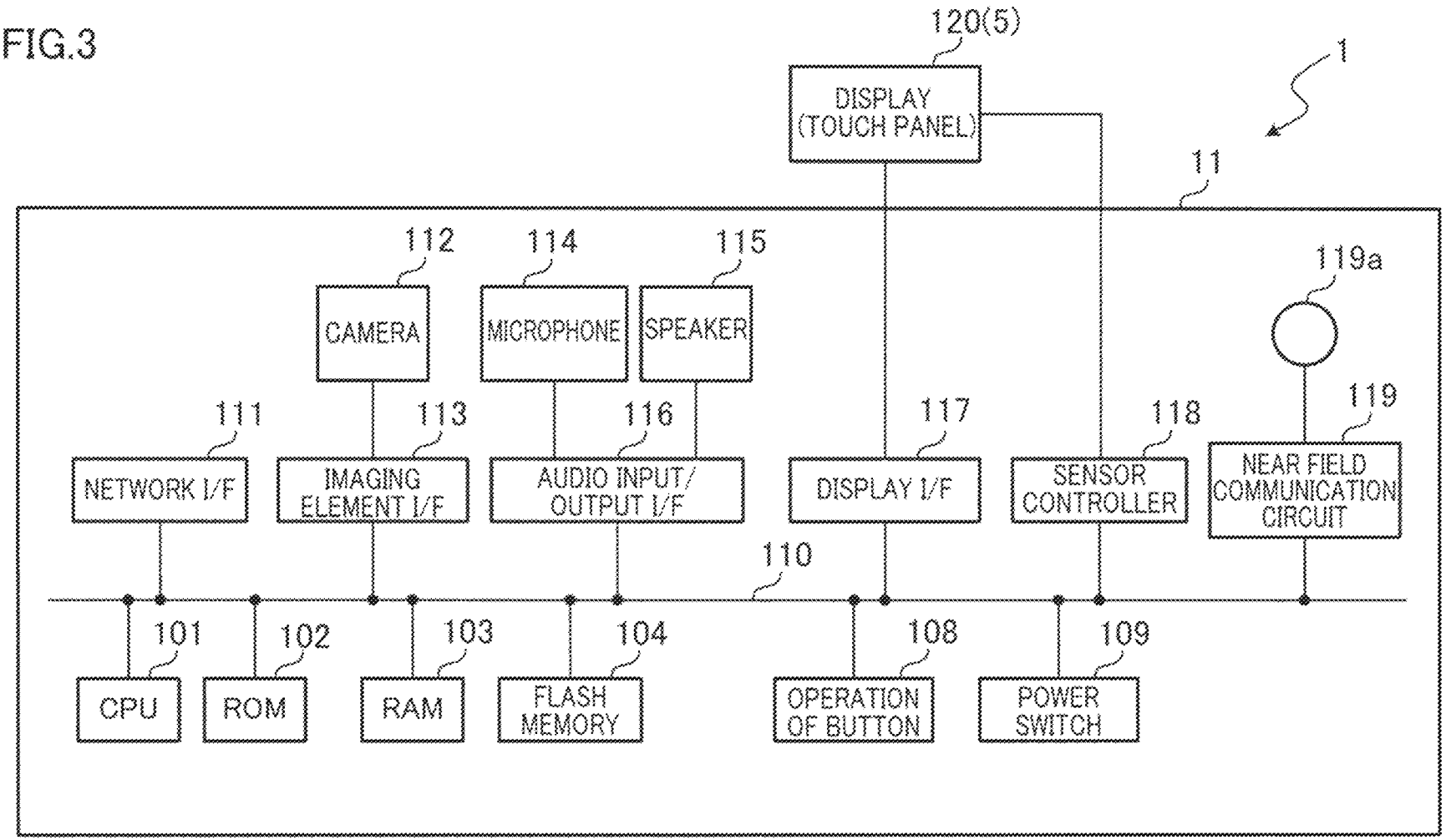
FIG. 3 is a block diagram of the electrical configuration of the smartphone (information processor).

As shown in FIG. 3, the smartphone 1 includes, in a housing 11, a CPU 101 (controller), a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119. In the front surface of the housing 11, a display 120 with a touch panel 5 (input section) is embedded.

The display 120 is configured to be able to display images. The display method of the display 120 is, for example, liquid crystal, organic electroluminescence, CRT (Cathode Ray Tube), or plasma.

The CPU (Central Processing Unit) 101 controls the entire smartphone 1. The ROM (Read Only Memory) 102 stores programs used for driving the CPU 101, such as an IPL (Initial Program Loader).

The RAM (Random Access Memory) 103 is used as a work area of the CPU 101. The flash memory 104 stores application software (program) for executing the game of the present embodiment, a communication program, and sets of data such as image data and sound data (such as a later-described symbol array of a video reel, a symbol combination table, game data necessary for a slot game, and the number of owned coins). The operation button 108 is used for, for example, initial setting of the smartphone 1. The power switch 109 is used for turning on/off the power source of the smartphone 1.

The network I/F (Interface) 111 is an interface for performing data communication with the server 100, etc., by utilizing a communication network such as the Internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 120 under the control of the CPU 101. The sensor controller 118 is a circuit for receiving an input from the touch panel 5 of the display 120. The near field communication circuit 119 is a communication circuit based on NFC (Near Field Communication) (Registered Trademark). Bluetooth (Registered Trademark), or the like. The bus line 110 is an address bus, a data bus, or the like for electrically connecting the components such as the CPU 101.

(Outline of Slot Game Executed by Smartphone 1)

In the smartphone 1 structured as above, the CPU 101 is programmed to execute application software of the slot game.

When the application software of the slot game is executed in the smartphone 1, game start effect images, etc., are displayed. Thereafter, login display is performed and communication with the server 100 becomes possible, upon selection of a selection image indicating the start of the slot game by the touch panel 5, and then the slot game starts (detailed later). For example, as shown in FIG. 1, when the slot game starts, a symbol display area 21 which is formed of 15 areas forming a matrix with 5 columns and 3 rows is displayed. Then the slot game of rearranging symbols in the symbol display area 21 is run (detailed later).

Plural types of slot games may be prepared for selection, and the rule, the state of payout, and effect images may be different depending on which slot game is executed. For example, in a slot game of one type, symbols are rearranged in a symbol display area formed of 9 areas forming a matrix with 3 columns and 3 rows. In this slot game, whether a win is achieved is determined based on a combination of symbols rearranged on a payline set only at the middle stage of the symbol display area (winning determination).

The slot game of the present embodiment is basically started in response to the consumption of a predetermined amount of coins (gaming media) owned by a player. When a predetermined condition is established, the slot game is started without the consumption of coins (e.g., a condition of awarding a free game is satisfied, or the slot game can be played without the consumption of coins for a predetermined number of times per day).

The coins (gaming media) owned by players are electronic information. A player accesses the server 100 via the smartphone 1 and exchanges credits to the coins in accordance with a payment method specified by the management organization of the slot game. The coins owned by players are used in various ways. For example, the coins are consumed to obtain an effect influencing on the slot game (as items), or consumed to change the appearance of an avatar of a player.

The number of coins owned by each player, which is managed by the server 100, is shared by communications between the server 100 and each smartphone 1. The flash memory 104 of the smartphone 1 stores the number of coins owned by each player, which is shared with the server 100.

Note that the gaming medium in the present invention is not particularly limited. Examples of the gaming medium include game media such as medals, tokens, cyber money, and tickets, when the slot game of the present embodiment is executed by a gaming machine (slot machine) installed in a hall or the like. A ticket is not particularly limited, and a barcoded ticket may be adopted for example. Alternatively, the gaming medium may be a game point not including valuable information.

(Slot Game: Definitions)

The slot game executed in the present embodiment is a game in which symbols are varied in the symbol display area 21 (scrolling image of reels) and then stopped (rearranged), and a benefit (e.g., a payout or an item advantageous or disadvantageous for the player) is awarded based on the combination of the symbols displayed in the symbol display area 21. A state in which symbols are displayed after being varied and stopped in the symbol display area 21 is termed "rearrangement".

A payout awarded based on a combination of symbols displayed in the symbol display area 21 is awarding of coins.

The "unit game" is a series of operations from the start of the receiving of a bet to the establishment of a prize (i.e., a combination of symbols satisfies a predetermined relation). To put it differently, the unit game includes a single bet time for receiving a bet, a single game time of rearranging stopped symbols, and a single payout time of a payout process of awarding a payout.

(Slot Game Screen)

A slot game screen displayed on the display 120 of the smartphone 1 will be described.

As shown in FIG. 1, when the slot game is executed, the slot game screen is displayed on the display 120.

The slot game screen displays the symbol display area 21 formed of 15 areas forming a matrix with 5 columns and 3 rows, a game information display area 22 on which information of increment and decrement in accordance with the execution of the slot game (e.g., the number of currently-owned coins) is displayed, an effect display area 23 on which moving and still images and messages related to the game are displayed in accordance with the progress of the slot game, and an operation display area 24 which is operated by the player to progress the slot game.

The operation display area 24 includes a spin button 241, an AUTO button 242, an ITEM button 243, a bet button 244, a WIN display portion 245, and a shop button 246.

On the entire surface of the display 120, a touch panel 5 which allows the slot game screen to be viewable from the outside is provided. The touch panel 5 makes it possible to detect the coordinates of a part touched by a player's finger or the like. With this arrangement, for example, the slot game (unit game) is executed once, upon a touch input of the image of the spin button 241. Furthermore, the slot game is serially executed plural times as the image of the AUTO button 242 is pressed. When the image of the ITEM button 243 is pressed, the player is able to select and use a previously-obtained item (which exerts an influence in the slot game). When the image of the shop button 246 is touched, the smartphone 1 accesses the server 100 and the player enters a shop in which credits (which can be bought by cash, a credit card, electronic money, a prepaid card, etc. owned by the player) are exchangeable with coins.

(Symbol Display Area 21)

Figure 4:
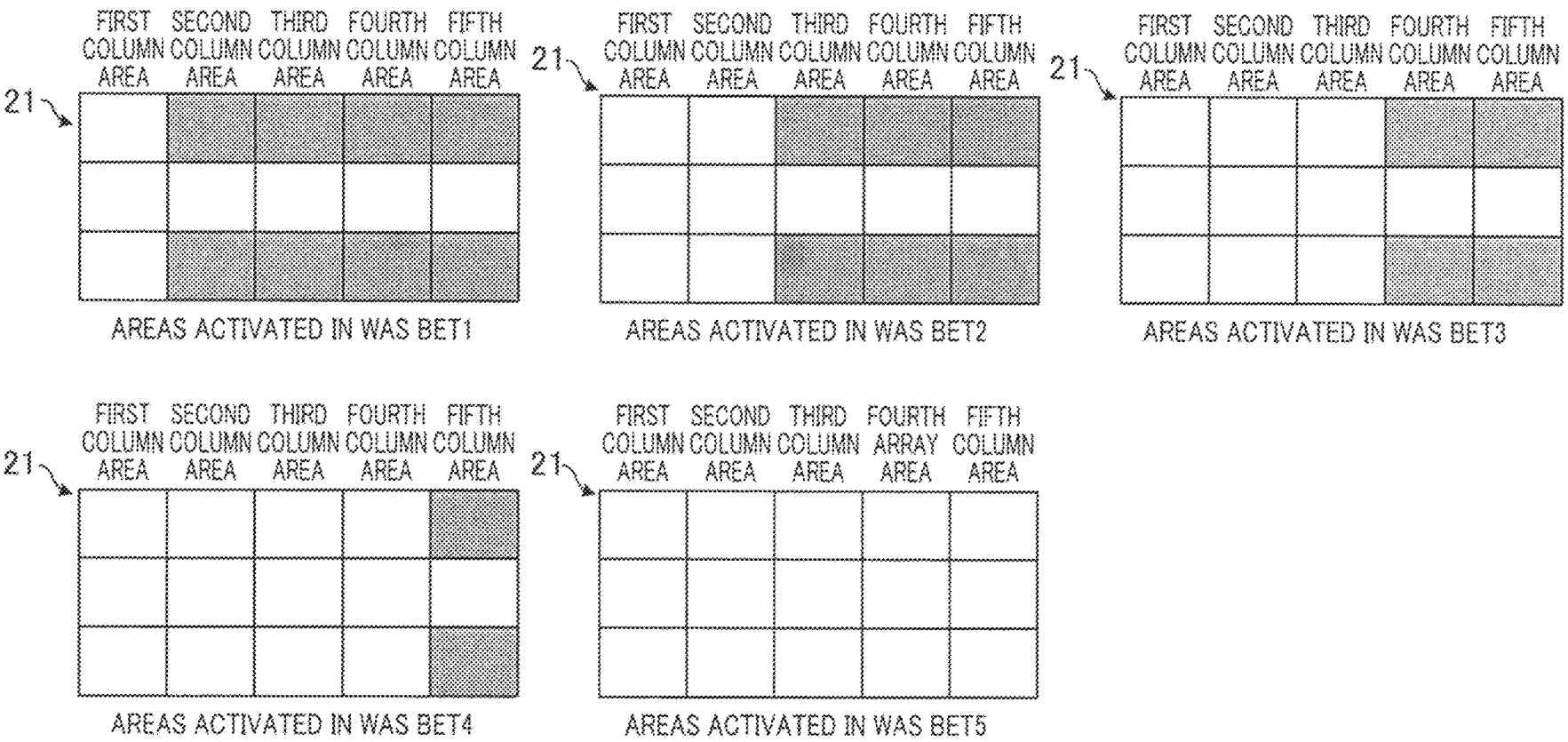
FIG. 4 illustrates active areas of "WAYS BET" in a slot game.
Figure 5:
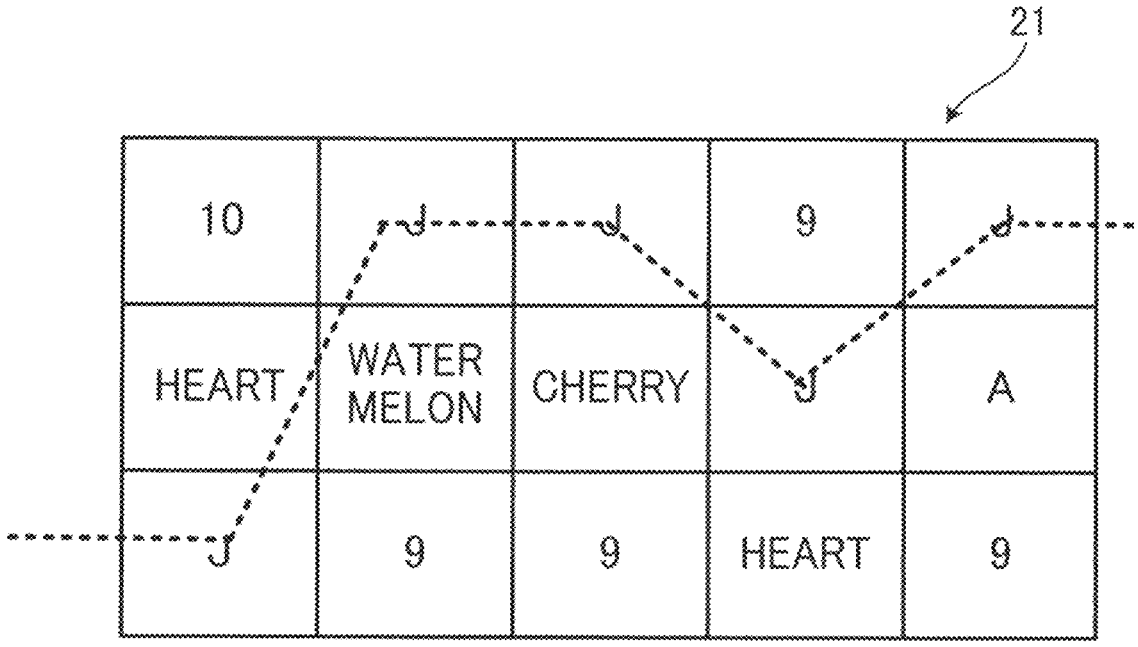
FIG. 5 is an explanatory diagram of an example of winning determination regarding "WAYS BET" in the slot game.

The symbol display area 21 of the slot game includes 5 column areas (first column area to fifth column area) each of which is divided into three areas: the upper stage, the middle stage, and the lower stage, as shown in FIG. 4 and FIG. 5. In the first column area to fifth column area, five video reels 3 (REEL1, REEL2, REEL3, REEL4, and REEL5) are displayed, respectively. In the slot game of the present embodiment, the video reels 3 are for expressing in the form of a video rotation and stop of symbols depicted on the circumferential surfaces of mechanical reels. To each of the video reels 3 (REEL1, REEL2, REEL3, REEL4, and REEL5), a symbol array formed of symbols is allocated (FIG. 6).

In the symbol display area 21, the symbol array allocated to each video reel 3 (REEL1, REEL2, REEL3, REEL4, and REEL5) scrolls, and stops after elapse of a predetermined time. As a result, parts of the respective symbol arrays (three successive symbols) are serially displayed in the symbol display area 21. In each of the first column area to the fifth column area of the symbol display area 21, one symbol is displayed in each of the three areas of the column area, i.e., the upper stage, the middle stage, and the lower stage, according to the corresponding video reel 3 (REEL1, REEL2, REEL3, REEL4, and REEL5). To put it differently, 15 symbols forming a matrix with 5 columns and 3 rows are displayed in the symbol display area 21.

As described above, in the symbol display area 21, 15 areas are provided to form a matrix in such a way that 5 column areas (columns) intersect three stages (stages) which are the upper stage, the middle stage, and the lower stage.

The slot game adopts a so-called "LEFT TO RIGHT" type for determination of a winning. That is, by selecting one of five stages of WAYS BET (WAYS BET1, WAYS BET2, WAYS BET3, WAYS BET4, and WAYS BET5), there are determined winning determination areas to be subjected to winning determination, out of 15 areas (the 5 by 3 matrix) of the symbol display area 21 (determination of active areas) (see FIG. 4). Then a win occurs when a predetermined number of symbols stopped in the winning determination areas of the first column area to fifth column area, which areas are subjected to winning determination, are linked (see FIG. 5).

The selection of one of the five stages of WAYS BET (WAYS BET1, WAYS BET2, WAYS BET3, WAYS BET4, and WAYS BET5) is done by touching a "+" button or a "−" button on the bet button 244 (see FIG. 1). 2 coins are required to select the WAYS BET1. 3 coins are required to select the WAYS BET2. 7 coins are required to select the WAYS BET3. 15 coins are required to select the WAYS BET4.

25 coins are required to select the WAYS BET5.

Specifically, as shown in FIG. 4, when "WAYS BET1" is selected, the areas out of the symbol display area 21 subjected to winning determination (areas activated) are: the upper stage, the middle stage, and the lower stage of the first column area; the middle stage of the second column area; the middle stage of the third column area; the middle stage of the fourth column area; and the middle stage of the fifth column area. Further, when "WAYS BET2" is selected, the areas out of the symbol display area 21 subjected to winning determination (areas activated) are: the upper stage, the middle stage, and the lower stage of the first column area; the upper stage, the middle stage, and the lower stage of the second column area; the middle stage of the third column area; the middle stage of the fourth column area; and the middle stage of the fifth column area. Further, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. Further, when "WAYS BET4" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the middle stage of the fifth column area. Further, when "WAYS BET5" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the upper stage, the middle stage, and the lower stage of the fifth column area.

For example, as shown in FIG. 5, when the "WAYS BET5" is selected, all the areas out of the symbol display area 21 are subjected to result determination (activated). As shown in FIG. 5, when "J: Jack" symbols stop in the lower stage of the first column area, the upper stage of the second column area, the upper stage of the third column area, the middle stage of the fourth column area, and the upper stage of the fifth column area, there is a single win in which the "J: Jack" symbols are linked from the first column area to the fifth column area (LEFT TO RIGHT). In the "LEFT TO RIGHT" type, the symbols may appear to be scattered at the first sight; however, if they are continuously linked throughout the first column area to the fifth column area, it is determined as a win. Although the slot game of the present embodiment adopts the "LEFT TO RIGHT" type, it is possible to adopt a line type which regards, as a winning line, a line connecting the middle stages of the column areas of columns. Alternatively, a scatter type may be adopted so that whether a win is achieved is determined in accordance with the number of symbols of the same type displayed on the symbol display area 21.

(Symbol Columns of Video Reels)

Now, with reference to FIG. 6, the following describes a configuration of the symbol arrays on the video reels 3 of the slot game.

As shown in FIG. 6, to each of "REEL1", "REEL2", "REEL3", "REEL4", and "REEL5" of the video reels 3, a symbol array formed of symbols corresponding to code numbers 0 to 33 is allocated. The types of the symbols in each symbol array of the video reel 3 include normal symbols "7", "HEART", "BELL", "WATERMELON", "CHERRY", "ACE (A)", "KING (K)", "QUEEN (Q)", "JACK (J)", "10", and "9" and a "WILD" symbol which is a symbol capable of functioning as any symbols (i.e., an almighty symbol).

(Symbol Combination Table)

Now, a symbol combination table will be described with reference to FIG. 7. FIG. 7 shows a symbol combination table used in the slot game of the present embodiment.

The symbol combination table of the slot game defines the combinations of symbols (the number of symbols) with which a win is achieved and payout amounts of coins paid out (payout). In the slot game, a win is achieved when the scroll of the symbol array of each video reel 3 is stopped and a predetermined number of symbols of a predetermined type displayed in the symbol display area 21 form a line which goes through the first column area to the fifth column area within the winning determination area set to be the subject of the winning determination by the WAYS BET described above. In accordance with the type of win, a benefit will be given to the player in the form of awarding a payout and the like.

Basically, a win is achieved when a predetermined number of symbols of a single type are arranged linked to one another, as in three-symbols (3Kind), four-symbols (4Kind), or five-symbols (5Kind) combination, through the first column area to the fifth column area, within the winning determination area set as the subject to winning determination, by the WAYS BET described above. The above symbols of the single type are "7", "HEART", "BELL", "WATERMELON", "CHERRY", "A", "K", "Q", "J", "10", and "9". The "WILD" substitutes the "7", "HEART", "BELL", "WATERMELON", "CHERRY", "A", "K", "Q", "J", "10", and "9" symbols.

For example, when "WAYS BET3" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. When the scroll of the symbol arrays of the video reels 3 (REEL1, REEL2, REEL3, REEL4, and REEL5) is stopped and the "7" symbols stop at the lower stage of the first column area, the upper stage of the second column area, and the middle stage of the third column area, it is determined that a win is achieved with three linked "7" symbols from the first column area to the third column area ("LEFT TO RIGHT") (i.e., 3Kind of "7" is achieved). In this case, the symbol combination table shown in FIG. 7 is referred to, and "50" is determined as the payout amount of coins. Based on the determined payout amount of coins, a payout is awarded.

In the slot game, a required bet amount (2 coins for WAYS BET1, 3 coins for WAYS BET2, 7 coins for WAYS BET3, 15 coins for WAYS BET4, and 25 coins for WAYS BET5) is determined for the first selection of the five stages of WAYS BET. The WAYS BET may be selected plural times in the unit game.

For example, when the WAYS BET3 (7 coins) is selected three times, the required total bet amount is 21 coins (7×3), and a payout amount is 50×3=150 when 3Kind of "7" is achieved.

[Contents of Program]

Figure 9:
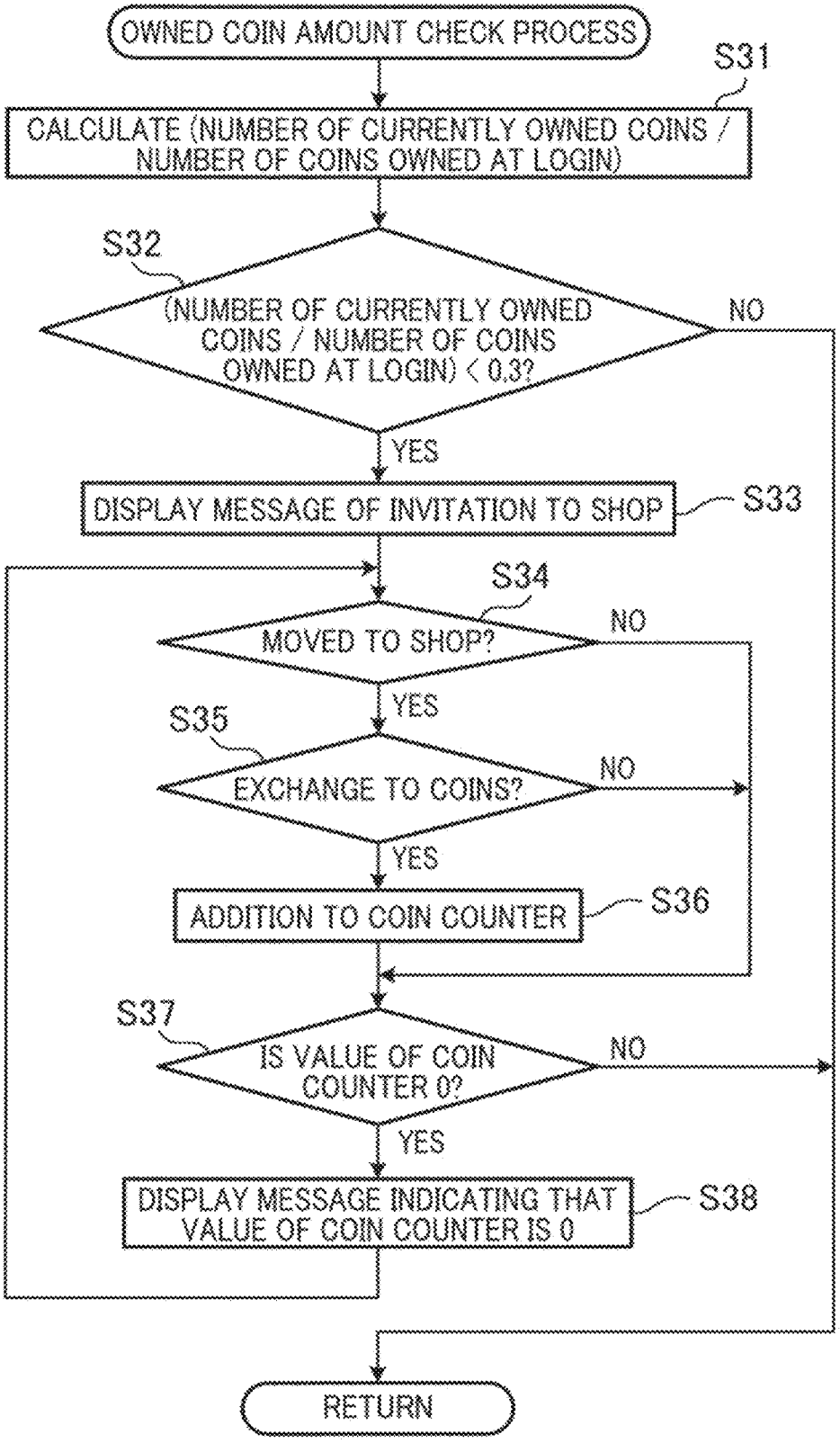
FIG. 9 is a flowchart of an owned coin amount check process.
Figure 10:
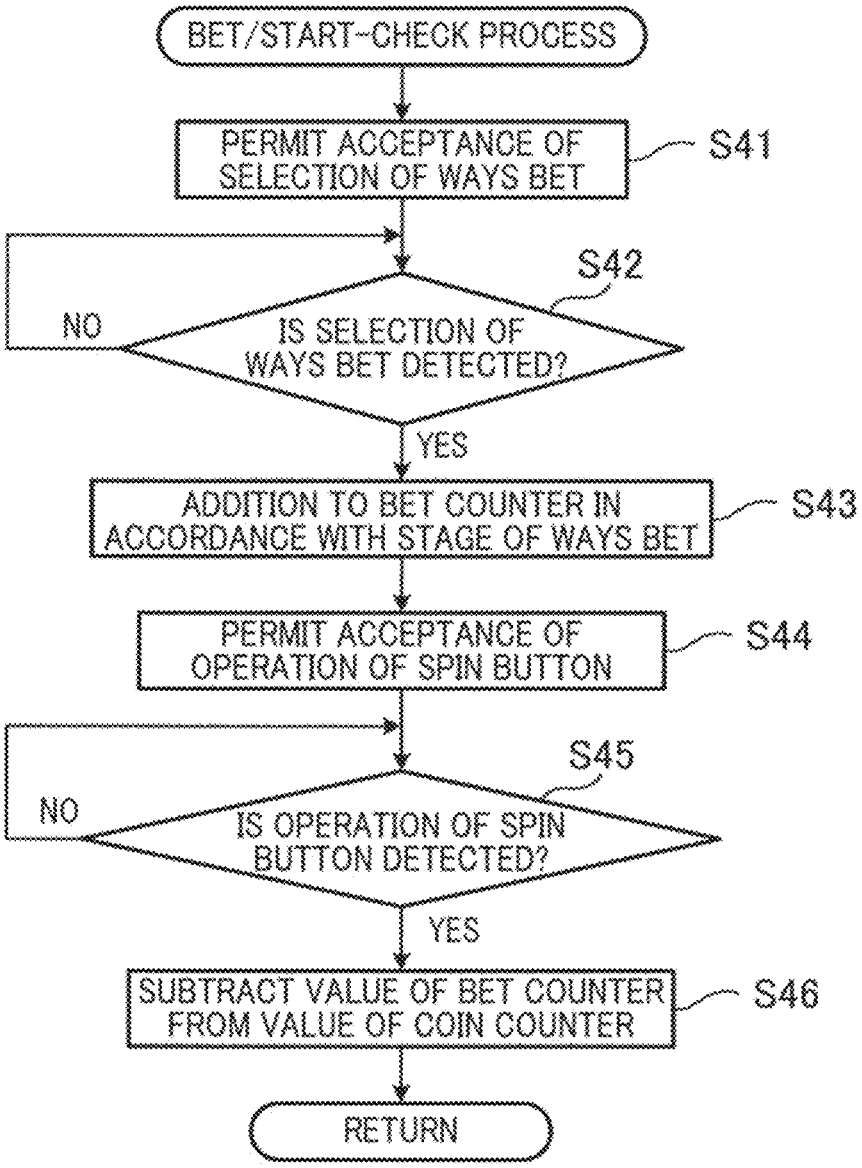
FIG. 10 is a flowchart of a bet/start check process.

Now, the program of the slot game executed by the smartphone 1 will be described with reference to FIG. 8 to FIG. 10.

(Main Control Process)

Figure 8:
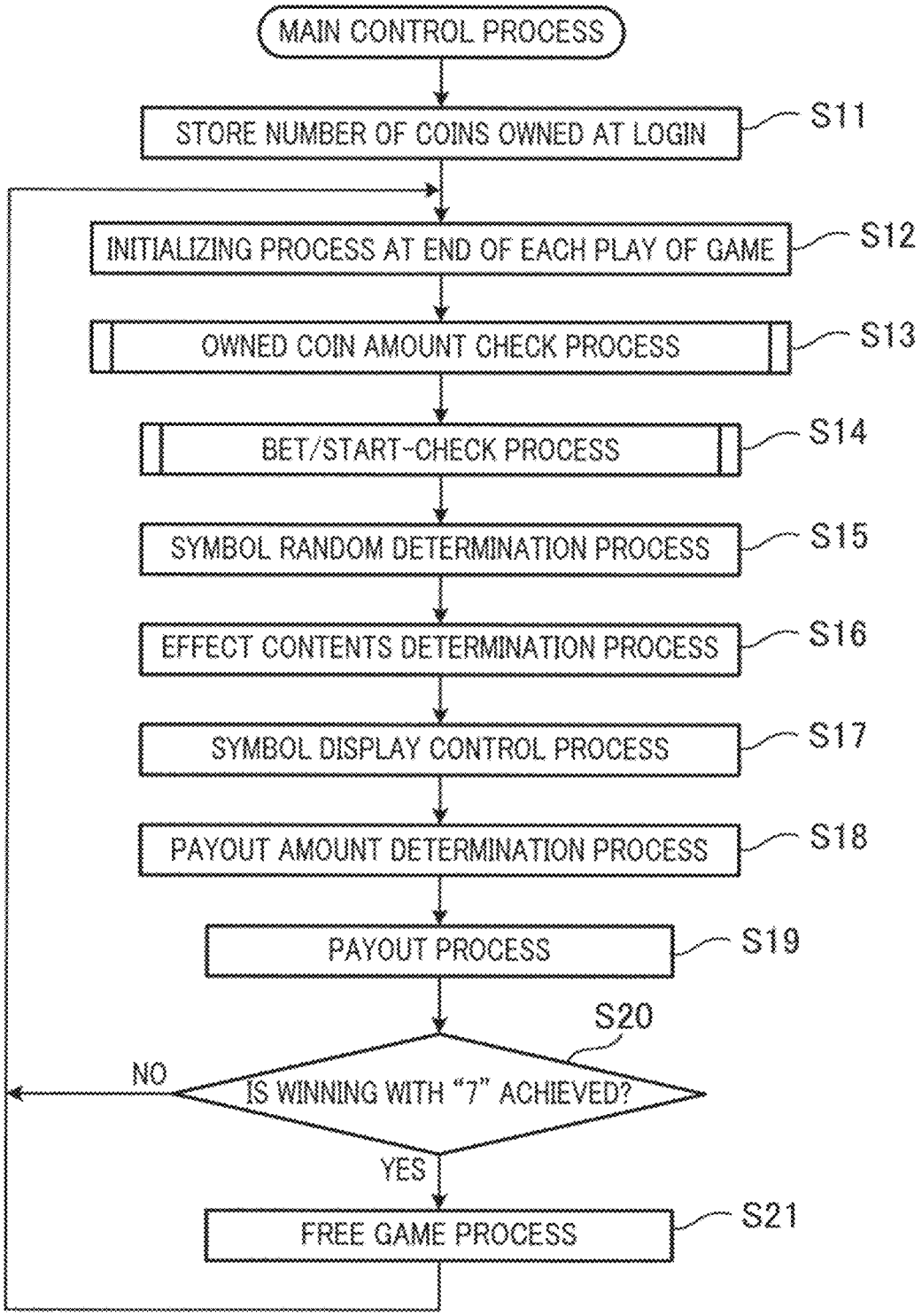
FIG. 8 is a flowchart of a main control process.

Referring to FIG. 8, a main control process will be described.

Figure 11:
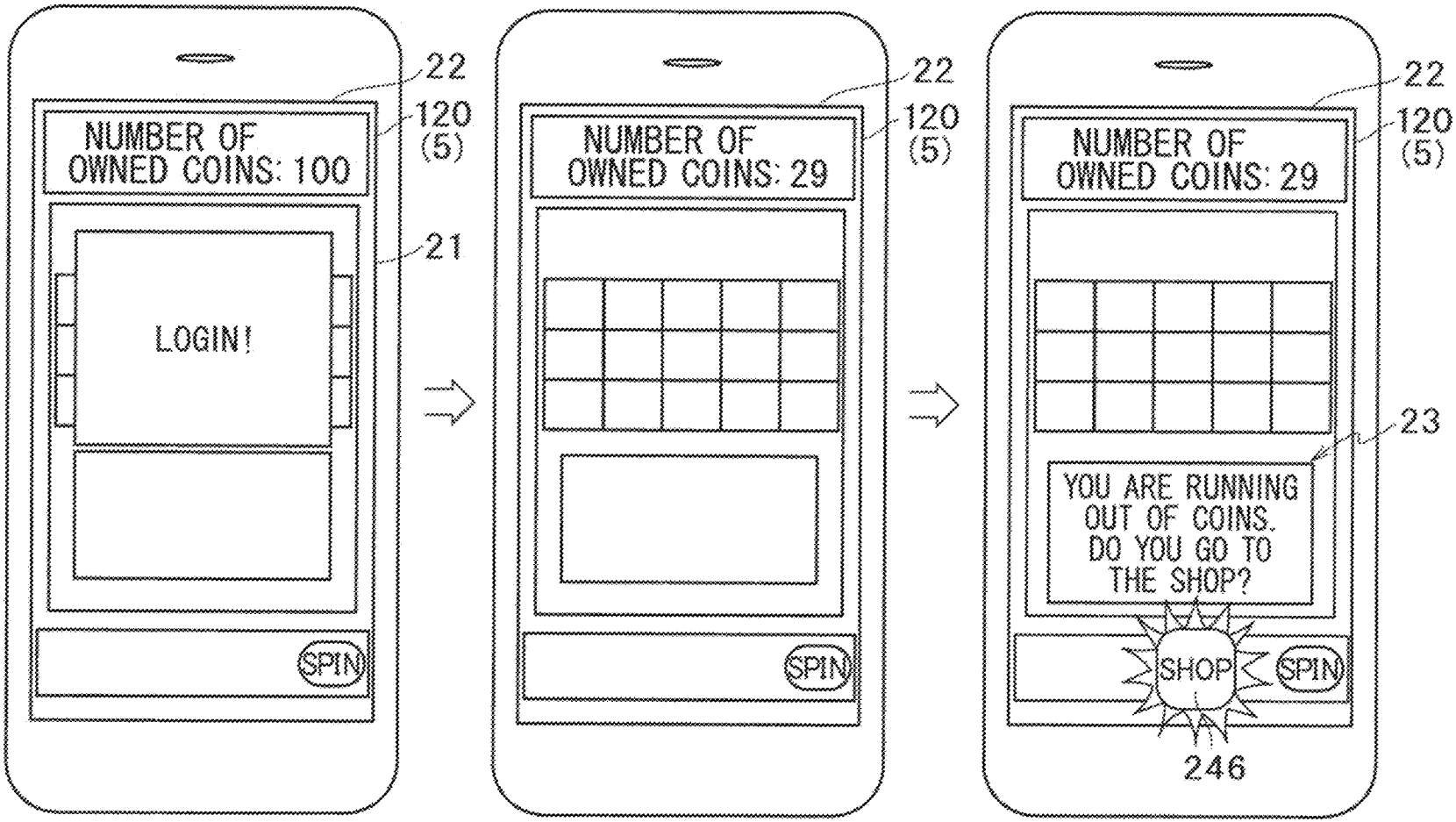
FIG. 11 shows a slot game displayed on a display.

When the application software of the slot game is executed, game start effect images, etc., of the slot game are displayed on the display 120. Thereafter, login display is performed on the display 120 upon selection of a selection image indicating the start of the slot game on the display 120 by the touch panel 5 (see FIG. 11). At this stage, on account of communication with the server 100, the number of coins owned by each player, which is managed by the server 100, is shared by communications between the server 100 and each smartphone 1. The coin counter of the flash memory 104 of the smartphone 1 stores the number of coins owned by each player, which is shared with the server 100. Then the value of the coin counter in the flash memory 104, which is shared with the server 100, is displayed in the game information display area 22 of the display 120, in the form of "Number of Owned Coins: " as shown in FIG. 11**.

Furthermore, in the present embodiment, when the player logs in the slot game by selecting a selection image displayed on the display 120 to start the slot game by the touch panel 5, the value of the coin counter at the time of the login (i.e., the number of coins owned by the player at the time of the login) is stored in the flash memory 104 as the number of coins owned at the time of the login (S11).

Subsequently, the main CPU 101 executes an initializing process at the end of each play of the game, in order to start the slot game (S12). For example, this process clears data in a working area of the flash memory 104, which becomes unnecessary at the end of each play of the unit game, e.g., WAYS BET activated in the previous execution of the unit game and symbols to be displayed on the symbol display area 21 as a result of random determination.

Subsequently, the CPU 101 executes an owned coin amount check process (S13). This owned coin amount check process will be explained with reference to the flowchart in FIG. 9.

To begin with, the CPU 101 divides the value of the coin counter provided in the flash memory 104 by the number of coins owned at the time of the login, which has been stored in S11 (S31). In other words, the ratio (%) of the number of coins currently owned by the player to the number of coins owned by the player at the time of the login to the slot game is calculated. For example, as shown in FIG. 11, when the current value of the coin counter (number of coins owned) is "29" and the number of coins owned at the time of the login stored in S11 is "100", the calculated value is "0.29 (29%)" as a result of "29/100=0.29".

Subsequently, the CPU 101 determines whether the value obtained in the step S31 is smaller than "0.3 (30%)" (S32). In other words, whether the ratio (%) of the number of coins currently owned by the player to the number of coins owned by the player at the time of the login to the slot game is smaller than "0.3 (30%)" is determined. When the value calculated in the step S31 is not smaller than "0.3 (30%)" (S32: No), the routine ends. For example, when the current value of the coin counter (number of coins owned) is "50" and the number of coins owned at the time of the login stored in S11 is "100", the calculated value is "0.5 (50%)" as a result of "50/100=0.5". Because the calculated value "0.5 (50%)" is not smaller than "0.3 (30%)", the routine ends.

Meanwhile, when the value calculated in the step S31 is smaller than "0.3 (30%)" (S32: Yes), a message of invitation to a shop is displayed in the effect display area 23 of the display 120 (S33). For example, when, as shown in FIG. 11, the current value of the coin counter (number of coins owned) is "29" and the number of coins owned at the time of the login stored in S11 is "100", "0.29 (29%)" is obtained by "29/100=0.29". Because the calculated value "0.29 (29%)" is smaller than "0.3 (30%)", a message "You are running out of coins. Do you go to the shop?" is displayed in the effect display area 23 of the display 120 as shown in FIG. 11. Along with this, the image of the shop button 246 blinks in a conspicuous manner. To put it differently, the image of the shop button 246 (input means) allowing the player to enter the shop where coins can be acquired is highlighted.

The CPU 101 then determines whether the image of the shop button 246 has been touched. (S34). When the image of the shop button 246 is touched (S34: Yes), the smartphone 1 accesses the server 100 and the player enters the shop in which credits (which can be bought by cash, a credit card, electronic money, a prepaid card, etc. owned by the player) are exchangeable with coins.

Subsequently, the CPU 101 determines whether credits are exchanged with coins in the shop (S35). When credits are exchanged with coins (S35: Yes), the number of the exchanged coins is added to the value of the coin counter in the flash memory 104 (S36). To put it differently, coins are obtained such that the image of the shop button 246 is touched to enter the shop and communication with the server 100 managing the number of coins owned by each player is performed, and when coins are obtained, the value of the coin counter in the flash memory 104 is updated.

After the step S36, if the image of the shop button 246 is not touched in S34 (S34: No) or if credits are not exchanged with coins in S35 (S35: No), the CPU 101 determines if the value of the coin counter in the flash memory 104 is "0" (S37). If the value of the coin counter is "0" (S37: Yes), a message indicating that the value of the coin counter is "0" is displayed in the effect display area 23 of the display 120 (S38). In other words, the player is notified that the number of coins owned by the player is "0". After S38, the routine proceeds to S34.

Meanwhile, when the value of the coin counter is not "0" in the step S37 (S37: No), the routine ends.

As the owned coin amount check process is executed, a message informing that the player is able to obtain coins in the shop is displayed when the number of coins currently owned by the player becomes smaller than 30% of the number of coins owned at the time of the login to the slot game as a result of the consumption of the coins. With this arrangement, the player is informed in advance to be able to obtain coins, before coins are consumed in the slot game or the like and the slot game becomes no longer playable. It is therefore possible to prompt the player to consume coins.

After the owned coin amount check process, the CPU 101 executes a later-described bet/start-check process (S14). In this process, input check or the like of the WAYS BET (WAYS BET1, WAYS BET2, WAYS BET3, WAYS BET4, or WAYS BET5) selected by the touch panel 5 or the like is performed. At this stage, as shown in FIG. 4, an area which is a target of winning determination in the symbol display area 21 as a result of the selection of WAYS BET is displayed with a white frame to be visually different from an area (with a black frame) which is not a target of winning determination. This makes it possible to visually differentiate an area which is a target of winning determination from an area which is not a target of winning determination.

The main CPU 101 then executes a symbol random determination process (S15). In this symbol random determination process, by using the symbol arrays of the video reels 3 shown in FIG. 6, to-be-stopped symbols are randomly selected from the symbols on the symbol arrays (REEL1, REEL2, REEL3, REEL4, and REEL5) of the video reels 3.

The to-be-stopped symbols are data of 5 symbols displayed in the middle stages of the first column area to the fifth column area of the symbol display area 21, among the symbols constituting the symbol arrays of the video reels 3. In this way, 15 symbols displayed in the symbol display area 21 are determined.

For example, in case of REEL1 of the video reel 3, when a code number "21" is randomly selected from 26 symbols (code numbers "0" to "25") forming the symbol array, the "CHERRY" symbol corresponding to the code number "21" is selected as the to-be-stopped symbol. In case of the REEL2, when a code number "10" is randomly selected from 29 symbols (code numbers "0" to "28") forming the symbol array, the "9" symbol corresponding to the code number "10" is selected as the to-be-stopped symbol. In case of the REEL3, when a code number "8" is randomly selected from 28 symbols (code numbers "0" to "27") forming the symbol array, the "CHERRY" symbol corresponding to the code number "8" is selected as the to-be-stopped symbol. In case of the REEL4, when a code number "7" is randomly selected from 27 symbols (code numbers "0" to "26") forming the symbol array, the "J" symbol corresponding to the code number "7" is selected as the to-be-stopped symbol. In case of the REEL5, when a code number "6" is randomly selected from 34 symbols (code numbers "0" to "33") forming the symbol array, the "Q" symbol corresponding to the code number "6" is selected as the to-be-stopped symbol.

The main CPU 101 stores the determined 5 to-be-stopped symbols in a symbol storing area in the flash memory 104.

The main CPU 101 then executes an effect contents determination process (S16). The main CPU 101 samples an effect-use random number and randomly determines any of a plurality of predetermined effect contents.

Then, the main CPU 101 executes a symbol display control process (S17). In this symbol display control process, scroll of the symbol arrays of the video reels 3 starts, and after a predetermined time elapses, five to-be-stopped symbols determined in the symbol random determination process in S14 are stopped one by one in the middle stages of the first column area to the fifth column area of the symbol display area 21. In other words, 15 symbols including the to-be-stopped symbols are rearranged in the symbol display area 21. For example, as described above, when the "CHERRY" symbol is selected as a to-be-stopped symbol in the REEL1, the "9" symbol is selected as a to-be-stopped symbol in the REEL2, the "CHERRY" symbol is selected as a to-be-stopped symbol in the REEL3, the "J" symbol is selected as a to-be-stopped symbol in the REEL4, and the "Q" symbol is selected as a to-be-stopped symbol in the REEL5, the symbols "CHERRY", "9", "CHERRY", "J", and "Q" are rearranged in the middle stages of the first column area to the fifth column area of the symbol display area 21. In the upper stages and the lower stages of the first column area to the fifth column area of the symbol display area 21, symbols having code numbers each of which is one number off the to-be-stopped symbols are rearranged (see FIG. 12).

The main CPU 101 then executes a payout amount determination process (S18). In this process, a symbol combination table for the slot game (see FIG. 7) stored in the flash memory 104 is referred to, to determine whether the symbols stopped in the symbol display area 21 include a predetermined number of symbols linked to one another through the first column area to the fifth column area in the WAYS BET set as the target of the winning determination, thus achieving a win. In accordance with the type of win, a benefit will be given in the form of awarding a payout and the like. The payout awarded is stored in a payout amount storage area of the flash memory 104.

Figure 12:
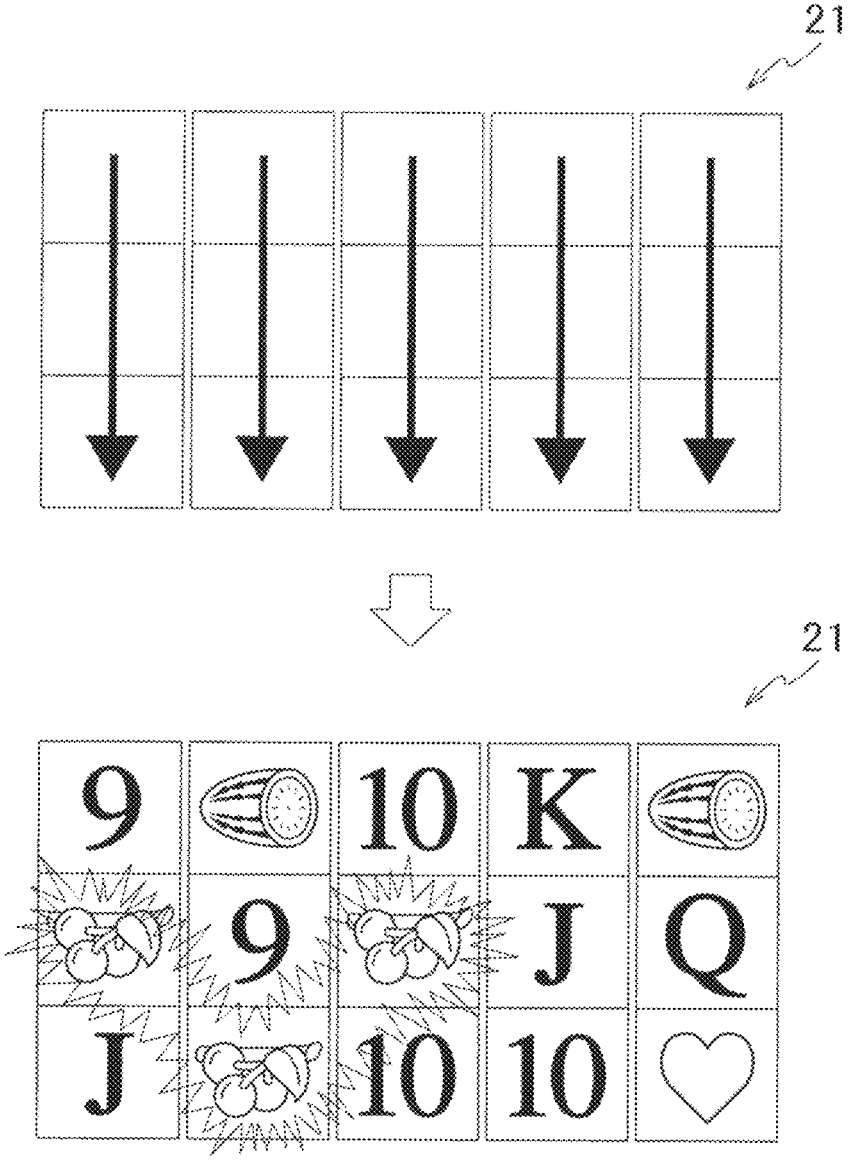
FIG. 12 shows a slot game displayed on a display.

For example, when "WAYS BET3" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. As shown in FIG. 12, when "CHERRY" symbols stop in the middle stage of the first column area, the lower stage of the second column area, and the middle stage of the third column area, there is a single win in which three "CHERRY" symbols are linked from the first column area to the third column area (LEFT TO RIGHT). To visually indicate that 3Kind of "CHERRY" is achieved, the three "CHERRY" symbols emit light and then flicker, as shown in FIG. 12. For the 3Kind of "CHERRY", a symbol combination table shown in FIG. 7 is referred to, and a payout is determined as "15" coins and this payout amount is stored in the payout amount storage area in the flash memory 104.

Then the CPU 101 executes a payout process (S19). The CPU 101 adds a value stored in the payout amount storage area to the value of the coin counter provided in the flash memory 104. For example, when "15" is stored in the payout amount storage area in the payout amount determination process in S18, "15" is added to the value of the coin counter.

Subsequently, the CPU 101 determines whether a winning with "7" (3Kind of "7", 4Kind of "7", or 5Kind of "7") is achieved (S20). When the "7" winning is achieved (S20: Yes), the CPU 101 executes a free game process. (S21). This free game process allows the player to play the slot game 20 times without the consumption of coins.

If the "7" winning is not achieved (S20: NO) or after S21, the process proceeds to S12.

(Bet/Start-Check Process)

Now, the bet/start-check process will be described with reference to FIG. 10.

To begin with, the main CPU 101 permits acceptance of selection of one of the 5 stages of WAYS BET (WAYS BET1, WAYS BET2, WAYS BET3, WAYS BET4, and WAYS BET5) input by pressing the "+" or "−" button (see FIG. 1) of the bet button 244 of the operation display area 24 on the touch panel 5 (S41).

By selecting any of the 5 stages of WAYS BET, a winning determination area to be subjected to winning determination is selected out of 15 areas of the 5 by 3 matrix of the symbol display area 21 (see FIG. 4).

Subsequently, the CPU 101 determines whether the selection operation (pressing) of any of the 5 stages of WAYS BET (WAYS BET1, WAYS BET2, WAYS BET3, WAYS BET4, and WAYS BET5) has been detected (S42). When the selection operation of the WAYS BET has not been detected (S42: No), the selection operation is waited for.

In the meanwhile, when the selection of one of the 5 stages of WAYS BET (WAYS BET1, WAYS BET2, WAYS BET3, WAYS BET4, and WAYS BET5) is detected (S42: Yes), the CPU 101 adds, to the value of the bet counter in the flash memory 104, coins necessary for the WAYS BET (2 coins in case of WAYS BET1, 3 coins in case of WAYS BET2, 7 coins in case of WAYS BET3, 15 coins in case of WAYS BET4, or 25 coins in case of WAYS BET5) (S43).

Subsequently, after S43, the main CPU 101 allows the spin button 241 to accept an operation (S44).

After S44, the main CPU 101 determines whether or not an operation of the spin button 241 is detected (S45).

When the main CPU 101 determines that an operation of the spin button 241 is not detected (S45: No), an operation of the spin button 241 is waited for.

In the meanwhile, when the main CPU 101 determines that an operation of the spin button 241 is detected (S45: Yes), the main CPU 101 subtracts the value of the bet counter calculated in S43 from the value of the coin counter (S46). Then the bet/start check process is terminated.

Other Embodiments

In the embodiment above, in the owned coin amount check process in S31, the value of the coin counter provided in the flash memory 104 is divided by the number of coins owned at the time of the login, which has been stored in S11. Alternatively, the value by which the value of the coin counter is divided may be the number of coins owned at the time of previous logout from the slot game or the number of coins owned at a predetermined time (e.g., 0:00 at which a date is changed).

When one of plural types of games is selectable (i.e., one of games such as slot game, poker, jackpot, and roulette is selectable), the number of coins owned at the time of selection of each type of the game may be treated as the number of coins owned at the time of the login.

Because communication between the smartphone 1 and the server 100 is required to log in the slot game, input of a password may be required for authentication. The authentication may be biometrics authentication instead of the password authentication, e.g., fingerprint authentication, iris authentication, or face recognition authentication.

Furthermore, while in S32 whether the value calculated in S31 is smaller than "0.3 (30%)" is determined, this value may not be "0.3 (30%)" and may be optionally set.

Furthermore, while the message of invitation to the shop is conspicuously displayed in the effect display area 23 of the display 120 in S33, the message may be a small popup image.

In S33, the existence of the shop where coins can be obtained is emphasized as the image of the shop button 246 blinks in a conspicuous manner. In this regard, an input for the entrance into the shop may be a sound input, or may be an input by detection of a motion by a motion sensor or detection of an eye movement.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

What is claimed is:

1. An information processor comprising:

a display configured to display a screen of a game, the screen being generated by downloading and executing a game program that is external to the information processor;

a storage device configured to store a gaming medium usable in the game and corresponding to a game player;

an interface connected over a computer network to an external management server system which manages the gaming medium corresponding to the game player; and a controller programmed to execute processes of:

comparing a second current amount of the gaming medium stored in the storage device corresponding to the game player with a first amount of the gaming medium corresponding to the game player at login to the game, which first amount is obtained via communication with the external management system;

displaying a predetermined message on the display when a relation between the first amount and the second current amount become lesser than or equal to a predetermined ratio;

wherein the predetermined ratio is associated with game player information; and, wherein the first amount at login corresponds to an amount of the gaming medium remaining before login, and the second current amount corresponds to a remaining amount of the gaming medium after login.

2. The information processor of claim 1, wherein the information processor comprises a mobile smart phone-type device.

3. An information processor comprising:

a display configured to display a screen of a game, the screen being generated by downloading and executing a game program that is external to the information processor;

a storage device configured to store a gaming medium usable in the game and corresponding to a game player;

an interface connected over a computer network to an external management server system which manages the gaming medium corresponding to the game player; and, a controller programmed to execute processes of:

(1a) at login to the game, storing a first amount of the gaming medium corresponding to the game player in the storage device;

(1b) enabling acquisition of the gaming medium by communication with the management server system managing the gaming medium, and if the gaming medium is acquired, updating the first amount of the gaming medium corresponding to the game player at login stored in the storage device to provide a second current amount of the gaming medium corresponding to the game player;

(1c) dividing the second current amount of the gaming medium stored in the storage device by the first amount of the gaming medium at login, which is stored in step (1a); and (1d) displaying a message notifying that a shift to process (1b) is possible on the display, when an amount calculated in process (1c) is lesser than or equal to a predetermined amount;

wherein the predetermined amount is associated with game player information; and, wherein the first amount at login corresponds to an amount of the gaming medium remaining before login, and the second current amount corresponds a remaining amount of the gaming medium after login.

4. The information processor according to claim 3, wherein, when in process (1d) the amount calculated in process (1c) is lesser than or equal to the predetermined amount, an input unit by which the shift to process (1b) is possible is presented.

5. The information processor of claim 4, wherein the information processor comprises a mobile smart phone-type device.

6. The information processor of claim 3, wherein the information processor comprises a mobile smart phone-type device.

7. A game control method comprising steps of:

(2a) at login to a game on an information processor, storing a first amount of a gaming medium corresponding to a game player and usable in the game, which is stored in a storage device;

(2b) enabling acquisition of the gaming medium by communication with an external management server system managing the gaming medium, and if the gaming medium is acquired, updating the first amount of the gaming medium corresponding to the game player at login stored in the storage device to provide a second current amount of the gaming medium corresponding to the game player;

(2c) dividing the second current amount of the gaming medium stored in the storage device by the first amount of the gaming medium at login, which is stored in step (2a); and (2d) displaying a message notifying that a shift to step (2b) is possible on a display, when an amount calculated in step (2c) is lesser than or equal to a predetermined amount;

wherein the predetermined amount is associated with game player information; and, wherein the first amount at login corresponds to an amount of the gaming medium remaining before login, and the second current amount corresponds a remaining amount of the gaming medium after login.

8. The game control method of claim 7, wherein the information processor comprises a mobile smart phone-type device.

9. A non-transitory computer readable storage device storing a game program executable by a computer of an information processor, upon execution the game program causing the computer to execute processes of:

(3a) at login to a game, storing a first amount of a gaming medium corresponding to a game player and usable in the game, which is stored in a storage device;

(3b) enabling acquisition of the gaming medium by communication with an external management server system managing the gaming medium, and if the gaming medium is acquired, updating the first amount of the gaming medium corresponding to the game player at login and stored in the storage device to provide a second current amount of the gaming medium corresponding to the game player;

(3c) dividing the second current amount of the gaming medium stored in the storage device by the first amount of the gaming medium at login, which is stored in step (3a); and (3d) displaying a message notifying that a shift to process (3b) is possible on a display, when an amount calculated in process (3c) is lesser than or equal to a predetermined amount;

wherein the predetermined amount is associated with game player information; and, wherein the first amount at login corresponds to an amount of the gaming medium remaining before login, and the second current amount corresponds a remaining amount of the gaming medium after login.

10. The non-transitory computer readable storage device of claim 9, wherein the information processor comprises a mobile smart phone-type device.

* * * * *